US005280543A

United States Patent [19]

Yokoyama et al.

[11] Patent Number: 5,280,543

[45] Date of Patent: Jan. 18, 1994

[54] ACOUSTIC APPARATUS AND DRIVING APPARATUS CONSTITUTING THE SAME

[75] Inventors: Kenji Yokoyama; Masao Noro, both of Hamamatsu, Japan

[73] Assignee: Yamaha Corporation, Hamamatsu, Japan

[21] Appl. No.: 54,862

[22] Filed: Apr. 27, 1993

Related U.S. Application Data

[63] Continuation of Ser. No. 633,945, Dec. 26, 1990, abandoned.

[30] Foreign Application Priority Data

Dec. 26, 1989 [JP] Japan ..... 1-335210

[51] Int. Cl.[5] ..... H04R 3/00

[52] U.S. Cl. ..... 381/96; 381/59; 381/76

[58] Field of Search ..... 381/96, 59, 76

[56] References Cited

U.S. PATENT DOCUMENTS

| | | | |
|---|---|---|---|
| 2,887,532 | 5/1959 | Werner . | |
| 3,023,274 | 2/1962 | Shaw | 381/76 |
| 3,037,081 | 5/1962 | Carlsson . | |
| 3,115,548 | 12/1963 | Stowell | 381/76 |
| 4,118,600 | 10/1978 | Stahl . | |
| 4,550,430 | 10/1985 | Meyers | 381/96 |
| 5,014,320 | 5/1991 | Nagi et al. | 381/96 |

FOREIGN PATENT DOCUMENTS

| | | |
|---|---|---|
| 0181608 | 11/1985 | European Pat. Off. . |
| 0293806 | 5/1988 | European Pat. Off. . |
| 0340762 | 5/1989 | European Pat. Off. . |
| 47-1010 | 1/1972 | Japan . |
| 58-29295 | 2/1983 | Japan . |

OTHER PUBLICATIONS

R. E. Werner and R. M. Carrell, Application of Negative Impedance Amplifiers to Loudspeaker Systems, Journal of the Audio Engineering Society, Oct. 1958, vol. 6, No. 4.

Richard E. Werner, Effect of a Negative Impedance Source on Loudspeaker Performance, Journal of the Acoustical Society of America, Mar. 1957, vol. 29, No. 3.

Karl Erik Stahl, Synthesis of Loudspeaker Mechanical Parameters by Electrical Means: A New Method for Controlling Low-Frequency Loudspeaker Behavior, Journal of the Audio Engineering Society, Sep. 1981, vol. 29, No. 9.

Warner Clements, A New Approach to Loudspeaker Damping, Audio Engineering Aug. 1951, vol. 35, No. 8.

A. N. Thiele, Loudspeakers in Vented Boxes: Part I, Journal of the Audio Engineering Society, May 1971, vol. 19, No. 5.

A. N. Thiele, Loudspeakers in Vented Boxes: Part II, Journal of the Audio Engineering Society, Jun. 1971, vol. 19, No. 6.

*Primary Examiner*—John K. Peng
*Assistant Examiner*—Nina Tong
*Attorney, Agent, or Firm*—Spensley Horn Jubas & Lubitz

[57] ABSTRACT

An acoustic apparatus comprises a cabinet, and a loudspeaker unit and a driving apparatus disposed in the cabinet. The acoustic apparatus is driven by an external power amplifier which normally constant-voltage-drives a conventional loudspeaker. The driving apparatus has a power amplifier circuit and a transfer function control circuit, and drives the loudspeaker unit in cooperation with the external power amplifier. The driving apparatus generates an electric energy corresponding to an increase in energy from that which is required in a normal constant-voltage-driving, the increase being produced by an operation of the transfer function control circuit, and the generated energy is inputted to the loudspeaker unit. By means of the above, when the acoustic apparatus is driven by the external power amplifier, an internal resistance of the loudspeaker unit is substantially cancelled or reduced, and an improvement of the electro-acoustic transducing characteristics of the loudspeaker unit or a loudspeaker system is achieved.

18 Claims, 8 Drawing Sheets

ACOUSTIC APPARATUS AND DRIVING APPARATUS CONSTITUTING THE SAME

This is a continuation of application Ser. No. 07/633,945 filed Dec. 26, 1990, now abandoned.

BACKGROUND OF THE INVENTION

1. Field of the Invention

The present invention relates to an acoustic apparatus which is connected to a general-purpose or usual power amplifier for normally driving a loudspeaker and improve electro-acoustic reproduction (transduction) characteristics of an loudspeaker constituting the acoustic apparatus, and a driving apparatus for driving the loudspeaker to improve its electro-acoustic reproduction characteristics in cooperation with the general-purpose power amplifier.

2. Prior Art

A conventional power amplifier for driving a loudspeaker (loudspeaker unit (vibrator) or a loudspeaker system) normally has a substantially zero output impedance, and constant-voltage drives the loudspeaker.

In contrast to this, recently, there are proposed acoustic systems which improve acoustic reproduction characteristics of loudspeakers or make a loudspeaker vibration system compact without impairing acoustic reproduction characteristics by so-called negative impedance driving (a negative impedance component is included in an output impedance) or so-called motional feedback (MFB) driving (a loudspeaker output is detected by a certain method) (European Patent Application Publication No. 0 322 686, No. 0 322 679, No. 0 322 053, U.S. Pat. No. 4,118,600 and the like).

However, these acoustic systems need special-purpose driving apparatuses (power amplifiers) corresponding to loudspeakers to be used. For this reason, when a user who possesses and regularly uses a general-purpose power amplifier wants to constitute the system, he or she cannot utilize his power amplifier at all.

Japanese Patent Application Laid-Open Gazette No. Sho 58-29295 discloses a technique that a loudspeaker is connected in series with a negative resistance circuit having a negative resistance at a predetermined frequency or less, and the series circuit of the loudspeaker and the negative resistance is driven by a general-purpose amplifier to improve bass tone range characteristics of the loudspeaker. However, as shown in FIG. 9, the negative resistance circuit uniquely disclosed in the embodiment of Japanese Patent Application Laid-Open Gazette No. Sho 58-29295 is a transistor class-A single amplifier which has a resistor as a load. Such a transistor class-A single amplifier is not used for supplying power to a low-impedance load such as a loudspeaker in terms of voltage utilization efficiency, power loss, cost, and the like except for a case wherein it is used for a very small power such as an earphone or a headphone, or a very special case like in a hobby use. More specifically, this transistor class-A single amplifier does not belong to a category of power amplifiers for driving a loudspeaker in a general idea. Furthermore, in this negative resistance circuit, an impedance Z which is a detection resistor corresponding to a detection resistor Rs for speaker current detection according to the present invention, is connected in series with the loudspeaker unit through a transistor and, an emitter resistor is connected at one end to a point where the emitter of the transistor and loudspeaker unit 2 are connected each other and is also connected at its other end to a grounding point. With this arrangement, a current that flows through the loudspeaker (speaker current) also flows through the emitter resistor at the time when the loudspeaker is driven, whereby it is made impossible to precisely detect the current (speaker current) flowing through the loudspeaker unit. Since this negative resistance circuit is not constituted by a push-pull circuit and; among A class amplifiers, the negative resistance circuit is restricted in its applicability, it cannot simply be replaced with a power amplifier circuit which precisely detects the speaker current thereby to enable it to output the optimal negative resistance and is generally suitable for driving the speaker.

More specifically, although Japanese Patent Laid-Open Gazette No. Sho58-29295 theoretically suggests that a loudspeaker can be negative-resistance driven using a general-purpose power amplifier by connecting the loudspeaker in series with a negative resistance circuit, it does not disclose or suggest an arrangement of a practical negative resistance circuit which can drive a loudspeaker without posing any problem.

SUMMARY OF THE INVENTION

The present invention has been made in consideration of the above situation, and has as its object to provide an acoustic apparatus and a driving apparatus which can directly utilize a conventional (usual) power amplifier, and can practically perform a driving operation for improving loudspeaker reproduction characteristics in the same manner as in the above-mentioned acoustic system.

In order to achieve the above object, according to the present invention, there is provided a driving apparatus (second power amplifier) for driving a loudspeaker in cooperation with a general-purpose power amplifier for normally driving the loudspeaker to improve electro-acoustic reproduction characteristics of the loudspeaker, and generating an electric energy corresponding to an increase in energy from that in a normal driving operation during the driving operation for improving the characteristics. A normal driving energy as another energy is supplied from the general-purpose power amplifier.

With this arrangement, since the normal driving energy is supplied from the general-purpose power amplifier as a conventional power amplifier, a user who regularly uses the general-purpose power amplifier can utilize it to realize negative-impedance driving or MFB driving, thereby improving electro-acoustic reproduction characteristics of his or her or a commercially available loudspeaker. Furthermore, a compact acoustic apparatus (loudspeaker system) which can automatically attain negative-impedance driving or MFB driving when it is driven by a general-purpose power amplifier, and has good electro-acoustic reproduction characteristics can be realized.

In the driving apparatus of the present invention, since an electric energy corresponding to an increase in energy caused by the negative-impedance driving or MFB driving is supplied from the second power amplifier, an output from the general-purpose power amplifier which cooperates with the second power amplifier can be efficiently utilized. Furthermore, since the second power amplifier need only supply an electric energy corresponding to an increase in energy caused by the negative-impedance driving or MFB driving, it can be rendered compact and inexpensive as compared to a conventional driving apparatus exclusively used for negative-impedance driving or MFB driving.

DETAILED DESCRIPTION OF THE PREFERRED EMBODIMENTS

Figure 1:
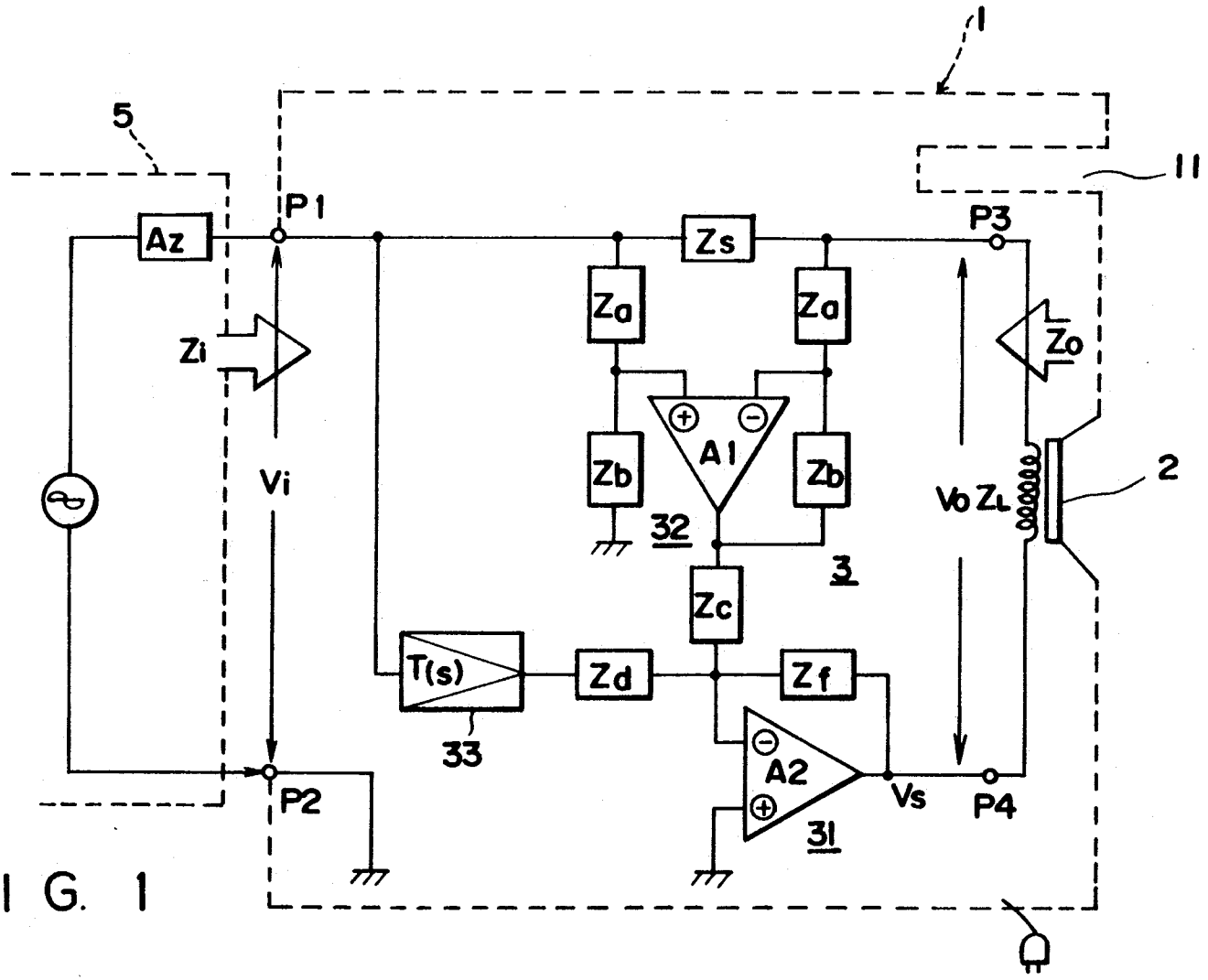
FIG. 1 is a circuit diagram showing an arrangement of an acoustic apparatus according to an embodiment of the present invention.

Preferred embodiments of the present invention will be described below with reference to the accompanying drawings. The same reference numerals or those with the same suffixes denote the common or corresponding parts throughout figures.

FIG. 1 shows an arrangement of an acoustic apparatus according to an embodiment of the present invention. This acoustic apparatus performs negative-impedance driving to improve loudspeaker characteristics. In this apparatus, a loudspeaker unit 2 and an amplifier unit 3 serving as a negative-impedance driving apparatus as the characteristics feature of the present invention are disposed in a cabinet 1 having a resonance duct port 11. The apparatus also has a pair of external input terminals P1 and P2 for connecting this acoustic apparatus to output terminals of a power amplifier 5 as a general-purpose power amplifier. The amplifier unit 3 comprises a power amplifier circuit 31, a positive feedback circuit 32, and a transfer function control circuit 33. The positive feedback circuit 32 comprises a feedback amplifier A1 given with a predetermined transfer function $\beta$ by an impedance element Zs for detecting a loudspeaker current, impedance elements Za and Zb, and the like. The impedance value of the impedance element Zs has a negligible magnitude as compared to that of the loudspeaker unit 2.

In the apparatus shown in FIG. 1, one external input terminal P1 is connected to one input terminal P3 of the loudspeaker unit 2 via the impedance element Zs for detecting the loudspeaker current, and the other input terminal P4 of the loudspeaker unit 2 is connected to an operation reference potential point of the amplifier unit 3. Furthermore, a detection output obtained by detecting a current flowing through the loudspeaker unit 2 by the impedance element Zs is positively fed back to the input of the power amplifier circuit 31 via the feedback amplifier A1. In addition, an input signal supplied to the external input terminal P1 is also supplied to the input of the power amplifier circuit 31 via the transfer function control circuit 33 having a predetermined transfer function.

Various characteristics of the amplifier unit 3 are as follows. That is, if an internal impedance of the loudspeaker unit 2 is represented by ZL, a transfer function (gain) of the transfer function control circuit 33 is represented by T(s), a transfer gain of the positive feedback circuit 32 is given by the equation, $\beta = Zb/Za$, a transfer gain of the power amplifier circuit 31 with respect to an output voltage of the transfer function control circuit 33 is given by the equation, $\alpha = Zf/Zc$, and a transfer gain of the power amplifier circuit 31 with respect to the output voltage of the positive feedback circuit 32 is given by $A = Zf/Zd$, (a) Transfer characteristics G(s) are expressed by:

$$G(s)_{j\omega} = \frac{v_o}{v_i} = \frac{1 + A \cdot T(s)}{1 + \frac{Zs}{ZL}(1 - \alpha \cdot \beta)} \quad (1)$$

(b) A driving impedance Zo when viewed from the loudspeaker unit 2 is given by:

$$Zo = ZL\left(\frac{G_{ZL=\infty}}{G_{ZL=ZL}} - 1\right) = Zs(1 - \alpha \cdot \beta) \quad (2)$$

where $G_{ZL=\infty}$ and $G_{ZL=ZL}$ are transfer characteristic values obtained when $ZL = \infty$ and $ZL = ZL$ are substituted in equation (1). An output impedance AZ of the power amplifier 5 is set to be 0 Ω.

(c) A load impedance Zi when viewed from the power amplifier 5 is given by:

$$Zi = \frac{ZL + Zo}{1 + A \cdot T(s)} \quad (3)$$

From these equations, (d) T(s) for making the transfer characteristics to be 1, i.e., for causing the output sound pressure of the loudspeaker to have the same frequency characteristics as those in a usual constant-voltage driving mode is given by:

$$T(s) = \frac{Zo}{A \cdot ZL} \quad (4)$$

(e) T(s) for making an amplitude of a voltage ($v_s$) at a negative impedance output terminal (output terminal of the power amplifier circuit 31) zero, i.e., for making $v_s$ zero when a loudspeaker is driven without being caused a counteraction from surrowding while maintaining an effect of a perfect damping state (Q of a loudspeaker driving system is 0) is given by:

$$T(s) = \frac{Zo - Zs}{A(ZL + Zs)} \quad (5)$$

In practice, however, since a counteraction from surrowding to the loudspeaker occurs, $v_s$ cannot be zero even if T(s) is set like in equation (5).

Operations of the variables in the acoustic apparatus shown in FIG. 1 were examined. Examination results are as follows.

(a) When $\alpha \cdot \beta = 1$ is set, since Zo=0 from equation (2), the apparatus is set in a constant-voltage driving state. In addition, since transfer characteristics are given by $1 = A \cdot T(s)$ from equation (1), frequency characteristics can be controlled by controlling T(s).

(b) From equation (2), in a region of $\alpha \cdot \beta > 1$, the output impedance Zo becomes negative.

(c) When T(s)=0, the apparatus can be operated as a negative impedance circuit aimed by Japanese Patent Application Laid-Open Gazette No. Sho. 58-29295.

(d) From equation (5), the magnitude of the negative impedance generator, i.e., the power amplifier 33 of the amplifier unit 3 can be reduced, and power consumption can be reduced.

(e) Optimal conditions can be set by setting $\alpha$, $\beta$, A, and T(s). In this case, T(s) serves as a transfer system for a phase inversion system $(-|T(s)|)$.

In FIG. 1, the amplifier unit 3 negative-impedance drives the loudspeaker unit 2 in cooperation with the power amplifier 5. This negative-impedance driving is performed in the same manner as in the acoustic apparatus disclosed in European Patent Application Publication No. 0 322 686. Accordingly, in the circuit shown in FIG. 1, for example, in a low frequency range, such negative resistance drive that is disclosed in European Patent Application Publication No. 322,686 is performed, whereby the speaker unit 2 is damped and driven extremely strongly and the reproduction characteristics, especially low frequency range characteristics thereof, is improved or whereby a cabinet can be made small in size, or a speaker system as a whole can be made small in size without damaging the reproduction characteristics.

Figure 2:
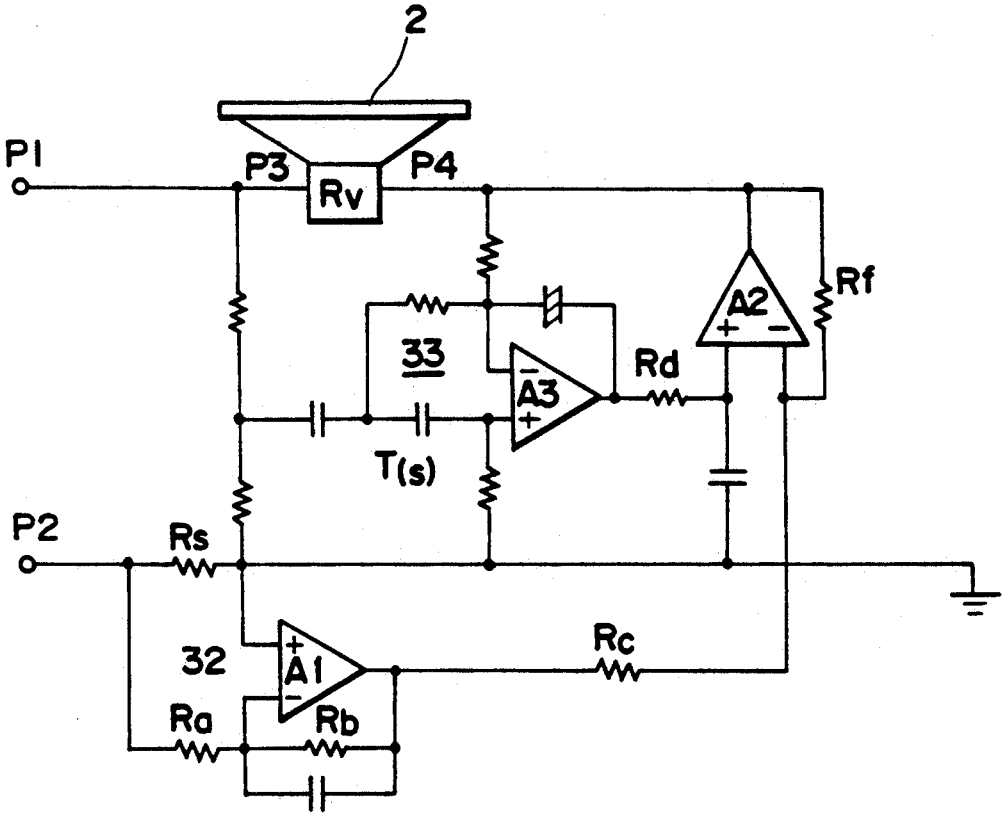
FIG. 2 is a circuit diagram showing an arrangement of an acoustic apparatus according to the second embodiment of the present invention.

FIG. 2 shows the second embodiment of the present invention. In this acoustic apparatus, a dynamic loudspeaker is used as the loudspeaker unit 2 to express the overall circuit in more detail as compared to the circuit shown in FIG. 1, and loudspeaker current detection operation is performed at a ground side. An internal impedance of the dynamic loudspeaker mainly consists of a resistance (Rv) of a voice coil, and slightly includes an inductance component. In this embodiment, a resistor Rs is used as the loudspeaker current detection impedance element Zs so that the output impedance Zo expressed by equation (2) serves as a negative resistance (−Rv) for canceling the internal resistance Rv. In addition, resistors are also used as impedance elements for determining the positive feedback gain $\alpha \cdot \beta$ and the amplifier gain A.

Furthermore, in the apparatus shown in FIG. 2, an amplifier A3 constituting the transfer function control circuit 33 also serves as a DC servo amplifier. More specifically, a signal supplied to the external input terminal P1 is non-inverting amplified by the amplifier A3 of the transfer function circuit 33, and the amplified signal is inputted to the non-inverting input terminal of an amplifier (internal power amplifier) A2 constituting the power amplifier circuit 31. In addition, by utilizing the inverted input terminal of the amplifier A3, a DC fluctuation of the internal power amplifier A2 is compensated for by negative feedback circuit (amplifier A2 and a capacitor).

Figure 3A:
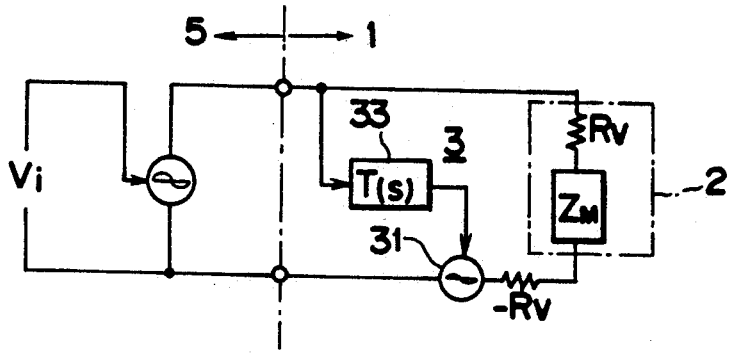
FIGS. 3A to 3C are respectively an equivalent circuit diagram of the acoustic apparatus shown in FIG. 2 and equivalent circuit diagrams of acoustic apparatuses according to the first and second prior arts.

As shown in the equivalent circuit diagram of FIG. 3A, the acoustic apparatus shown in FIG. 2 generates a negative resistance (−Rv) for canceling the internal impedance Rv of the loudspeaker unit 2 independently of the loudspeaker unit 2. For this reason, the loudspeaker unit 2 is equivalent to a circuit in which a motional impedance $Z_M$ is directly connected to voltage sources 5 and 31 without going through an impedance such as the internal impedance Rv or the like. Since the voltage sources have an internal impedance of zero respectively, the motional impedance $Z_M$ of the loudspeaker unit 2 is short-circuited at its two ends so that its resonance frequency Q becomes zero. As a result, the loudspeaker is set in a perfect dead state, and is very strongly driven and damped. In this acoustic apparatus, the transfer function T(s) of the transfer function control circuit 33 is appropriately set so that the output voltage of the power amplifier circuit 31 for generating a negative resistance is decreased, thus power supply from the power amplifier 5 can be increased, and desired frequency compensation in a negative-impedance driving mode can be performed.

This acoustic apparatus has a merit in that a conventional general-purpose power amplifier can be directly used, and characteristics unique to the power amplifier can be directly used, and characteristics unique to the power amplifier can be sufficiently reflected when the loudspeaker is driven.

Figure 3B:
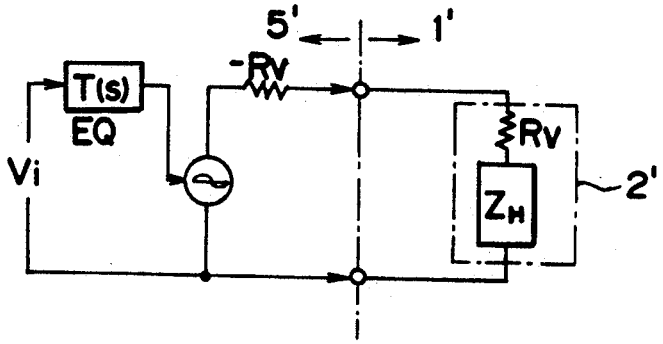
FIG. 3B PRIOR ART

In contrast to this, as shown in the equivalent circuit diagram of FIG. 3B, since a negative impedance driving apparatus disclosed in European Patent Application Publication No. 0 322 686 cause an amplifier 5' side (left side of the one dotted and one dashed line in FIG. 3B) to have a negative impedance, a special-purpose amplifier which includes a negative impedance in its output impedance must be used as the amplifier 5', and the amplifier and the loudspeaker must be paired, resulting in poor versatility (or generality).

Figure 3C:
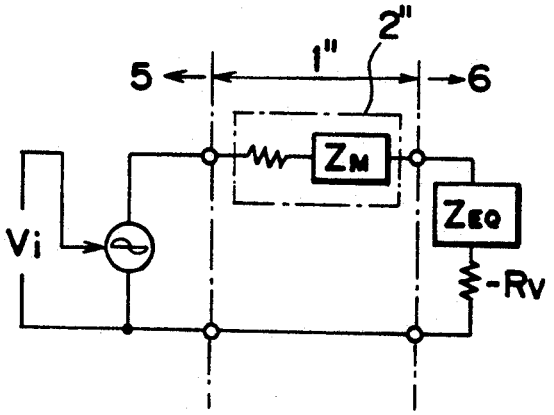
FIG. 3C PRIOR ART
Figure 9:
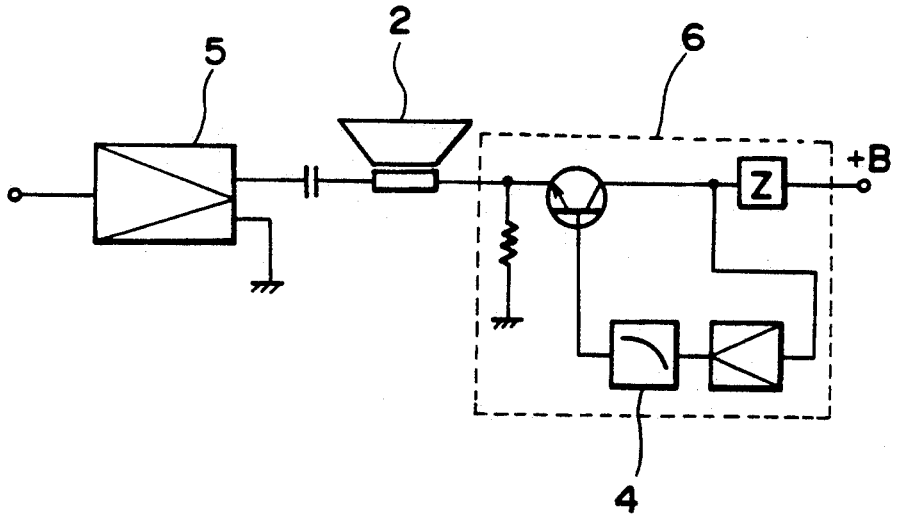
F I G. 9 PRIOR ART
FIG. 9 is a circuit diagram showing an arrangement of an acoustic apparatus according to a prior art (Japanese Patent Application Laid-Open Gazette No. Sho 58-29295).

In a loudspeaker driving apparatus disclosed in Japanese Patent Laid-Open Sho. No. 58-29295, as shown in the equivalent circuit diagram of FIG. 3C, a negative impedance (−Rv) is connected in series with a loudspeaker 1". When the negative resistance is connected in this manner, an equalizer circuit such as the transfer function control circuit 33 is required to adjust output characteristics of the loudspeaker. The equalizer circuit may be connected in series with the loudspeaker unit 2", as indicated by $Z_{EQ}$ in FIG. 3C. In this case, the effect of the negative resistance −Rv is reduced, and the damping force of the motional impedance $Z_M$ of the loudspeaker unit 2 is decreased. Furthermore, as shown in FIG. 9, since the negative resistance (−Rv) circuit is constituted by a transistor class-A amplifier including an emitter resistor as a resistance load, this transistor equivalently drives a parallel circuit of the loudspeaker 2 and the emitter resistor. Therefore, when this emitter resistance is set to be sufficiently smaller than the impedance of the loudspeaker unit 2, power consumption of the negative resistance transistor is increased beyond a practical level. On the other hand, when the emitter resistance is increased, since the emitter resistance is connected in series with the loudspeaker unit 2 with respect to the amplifier 5, the output from the amplifier 5 is consumed and decreased by the emitter resistance. In any case, the negative resistance circuit disclosed in Japanese Patent Appln. Laid-Open Gasette No. Sho 58-29295 is not practical in terms of cooperation with a general-purpose amplifier.

The apparatus of the present invention has not such defects as those in the conventional apparatus disclosed in Japanese Pat. Appln. Laid-Open Gazette No. Sho 58-29295 since the former has an element (resistor) for detecting a current flowing through the speaker, between the loudspeaker unit and the negative resistance circuit. In addition, the conventional apparatus wherein an element for detecting a current through a speaker is arranged between a power source B+ and a negative resistance circuit, cannot constitute a push-pull circuit (since + and − must be taken into consideration).

Figure 4:
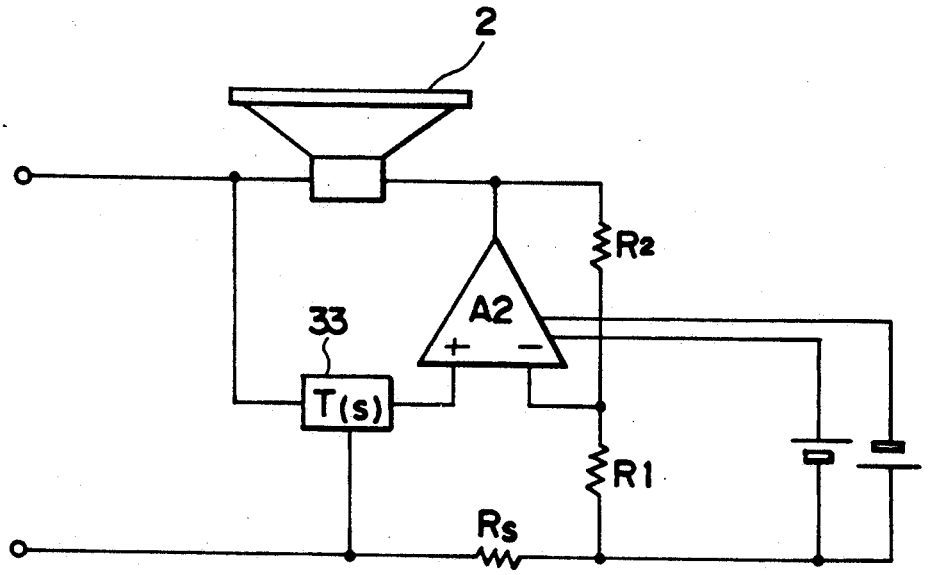
FIG. 4 is a circuit diagram of an acoustic apparatus according to the third embodiment of the present invention.

FIG. 4 shows the third embodiment of the present invention.

In the acoustic apparatus shown in FIG. 4, an output from the transfer control function control circuit 33 is shifted by a voltage across the loudspeaker current detection resistor Rs, and is amplified by the amplifier circuit 31 with reference to a voltage at the right terminal side (FIG. 4) of the resistor Rs.

Figure 5:
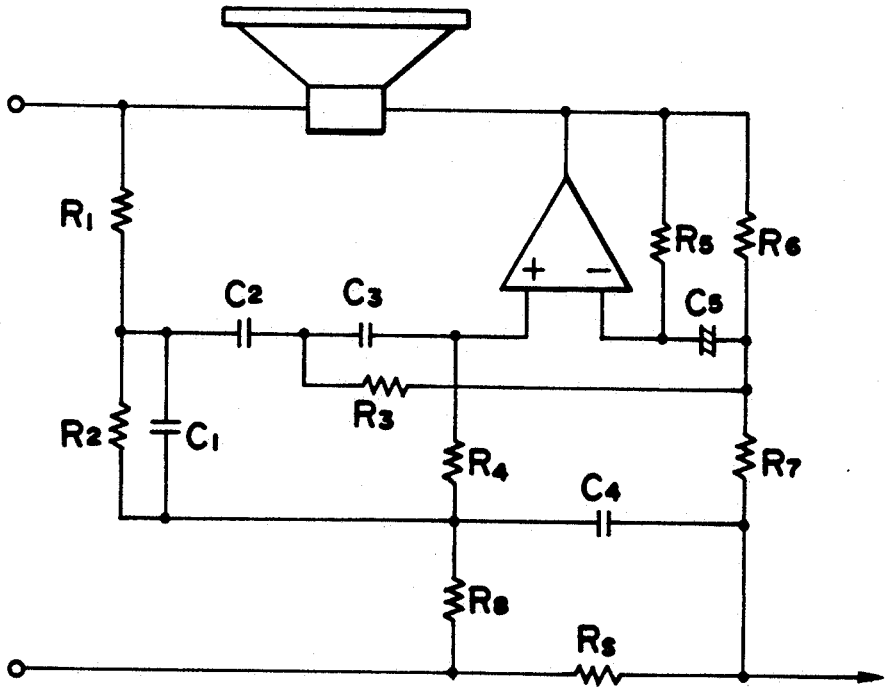
FIG. 5 is a detailed circuit diagram of the acoustic apparatus shown in FIG. 4.

FIG. 5 is a detailed circuit diagram of the acoustic apparatus shown in FIG. 4. In the apparatus shown in FIG. 5, the transfer function control circuit 33 is constituted by only passive elements.

Figure 6:
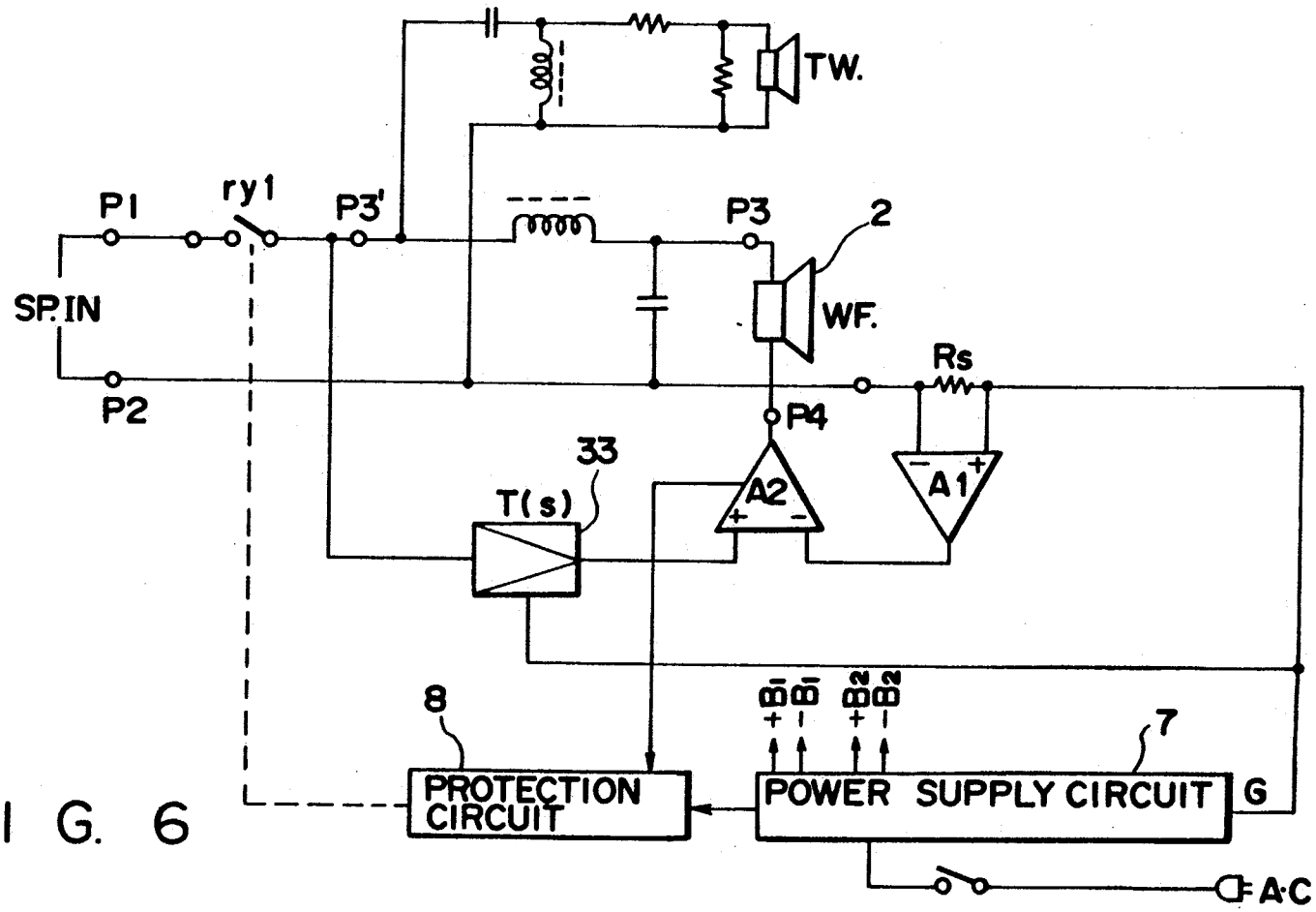
FIG. 6 is a circuit diagram of an acoustic apparatus according to the fourth embodiment of the present invention.

FIG. 6 shows the fourth embodiment of the present invention.

The acoustic apparatus shown in FIG. 6 drives a woofer WF of a two-way loudspeaker system by a negative-impedance circuit as the characteristic feature of the present invention. In FIG. 6, a power supply 7 generates DC power supply voltages $+B_1$ and $-B_1$ for the power amplifier A2 and DC power supply voltages $+B_2$ and $-B_2$ for the current detection amplifier A1, the amplifier A3 in the transfer function circuit 33, and a protection circuit 8 on the basis of an AC power supply, e.g., a commercial power supply of 100 V. The protection circuit 8 is used to prevent destruction or degradation of the circuits and the loudspeaker units caused by an overload, transient, or abnormal operation. The protection circuit 8 has a DC protection function of turning off a relay contact ry1 when a DC current exceeding a predetermined value flows through the loudspeaker unit, an overcurrent protection function of turning off the relay contact ry1 when an overcurrent flows through the loudspeaker unit, a heat radiation plate temperature protection function of turning off the relay contact ry1 when the temperature of a heat radiation plate exceeds a predetermined value, and a power-on muting function of turning on the relay contact ry1 after the lapse of a predetermined delay time when a power switch is turned on. This apparatus also has protection means, e.g., for a primary fuse, a temperature fuse in a transformer, and the like (not shown).

Figure 7:
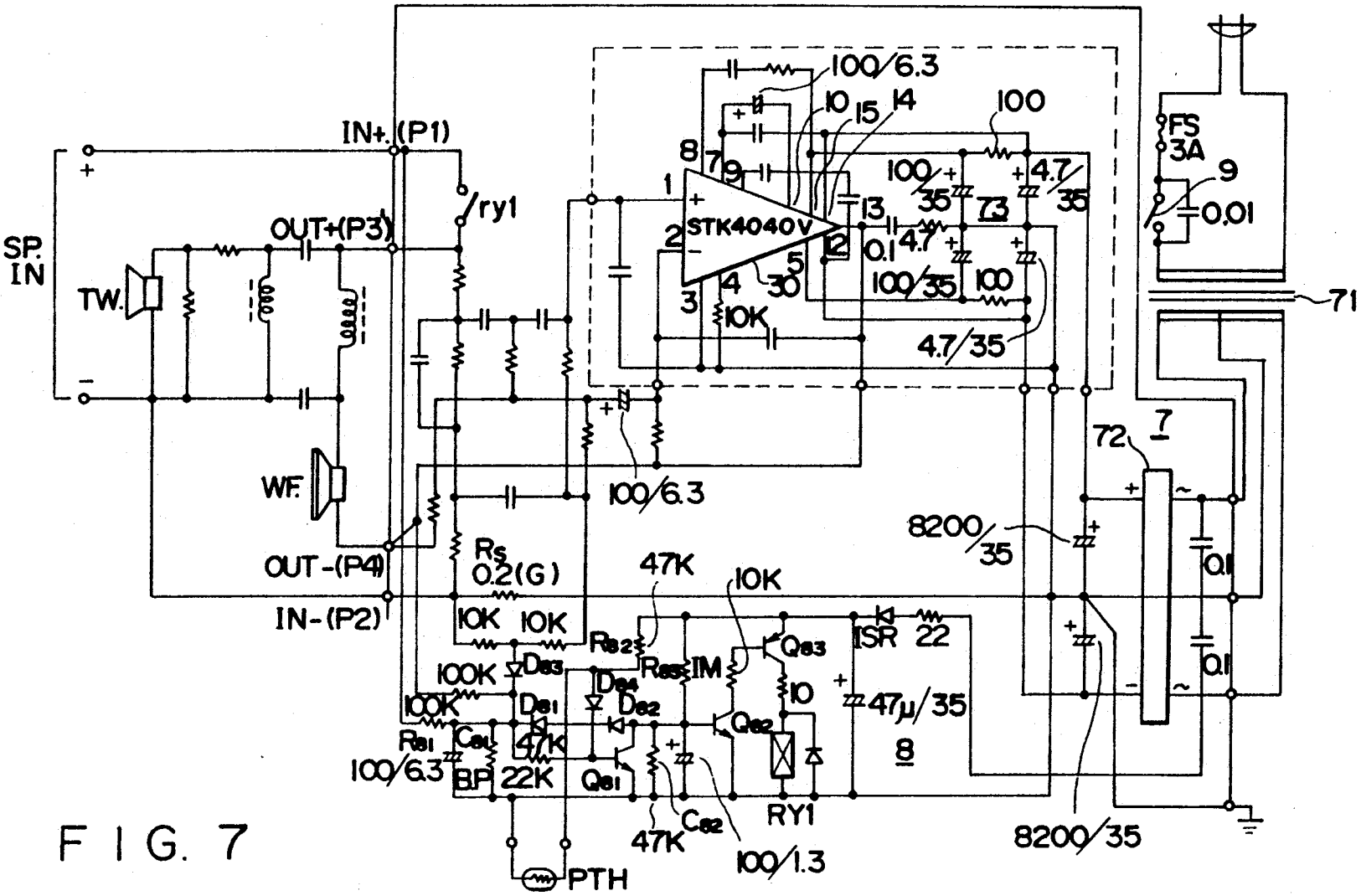
FIG. 7 is a detailed circuit diagram of the acoustic apparatus shown in FIG. 6.

FIG. 7 is a detailed circuit diagram of the acoustic apparatus shown in FIG. 6. In FIG. 7, an IC (STK4040V) 30 is a hybrid IC formed by integrating the amplifiers A1, A2, and A3, and some of their peripheral circuits shown in FIG. 6. A DC power supply 7 comprises a power supply transformer 71 having a central tap type secondary winding voltage, and a full-wave rectification circuit 72, and generates two DC voltages $+B_1$ and $-B_1$. These voltages are directly supplied to the amplifier A2 in the IC 30, and are also supplied to a circuit including the amplifiers A1 and A3, and the like as voltages $+B_2$ and $-B_2$ via a decoupling circuit 73. The speaker current detection resistor Rs has a resistance 0.2 Ω.

In the protection circuit 8, a resistor $R_{81}$ and a capacitor $C_{81}$ allow only a DC voltage component of a signal appearing at the external input terminal P1 to pass therethrough. When this DC voltage is equal to or higher than +0.6 V, a transistor $Q_{81}$ is turned on, and transistors $Q_{82}$ and $Q_{83}$ are turned off. Thus, a relay solenoid RY1 is deenergized, and the relay contact ry1 is turned off. When the DC voltage component is equal to or lower than −0.6 V, a base current of the transistor $Q_{82}$ is bypassed through diodes $D_{81}$ and $D_{82}$, and the transistors $Q_{82}$ and $Q_{83}$ are turned off to deenergize the relay solenoid RY1. The protection circuit 8 realizes the DC protection function with these operations. When an overcurrent flows through the loudspeaker unit (woofer WF.) 2, and AC voltage across the current detection resistor Rs is increased. This AC voltage is supplied to the base of the transistor $Q_{81}$ via the diode $D_{83}$. Therefore, if voltage is equal to or higher than +0.6 V, the transistor $Q_{81}$ is turned on and the transistors $Q_{82}$ and $Q_{83}$ are turned off to deenergize the relay solenoid RY1, as described above. As a result, the relay contact ry1 is turned off. That is, the overcurrent protection function is realized. When the temperature of the heat radiation plate is increased, the resistance of a positive characteristic thermistor PTH attached to the same heat radiation plate (not shown) as that to which the IC 30 is attached is increased. When the temperature of the heat radiation plate exceeds a predetermined value, a voltage-divided value of the resistor $R_{82}$ and the positive characteristic thermistor PTH exceeds 1.2 V. Thus, the transistor $Q_{81}$ is supplied with the base current through a diode $D_{84}$, and is turned on. The transistors $Q_{82}$ and $Q_{83}$ are turned off to deenergize the relay solenoid RY1, and the relay contact ry1 is turned off. That is, the heat radiation plate temperature protection function can be realized. When the power switch 9 is turned on, a capacitor $C_{82}$ is charged through a resistor $R_{83}$, and the transistors $Q_{82}$ and $Q_{83}$ are kept off until the terminal voltage across the capacitor $C_{82}$ exceed 0.6 V. Therefore, during this interval, the relay contact ry1 is kept off, and a signal to the woofer WF. and a circuit corresponding to the amplifier unit 3 is cut off. That is, the power-on muting function can be realized.

As the protection means for this apparatus, a primary fuse FS is arranged. In addition, a temperature fuse (not shown) is also arranged in the power supply transformer 71.

Figure 8:
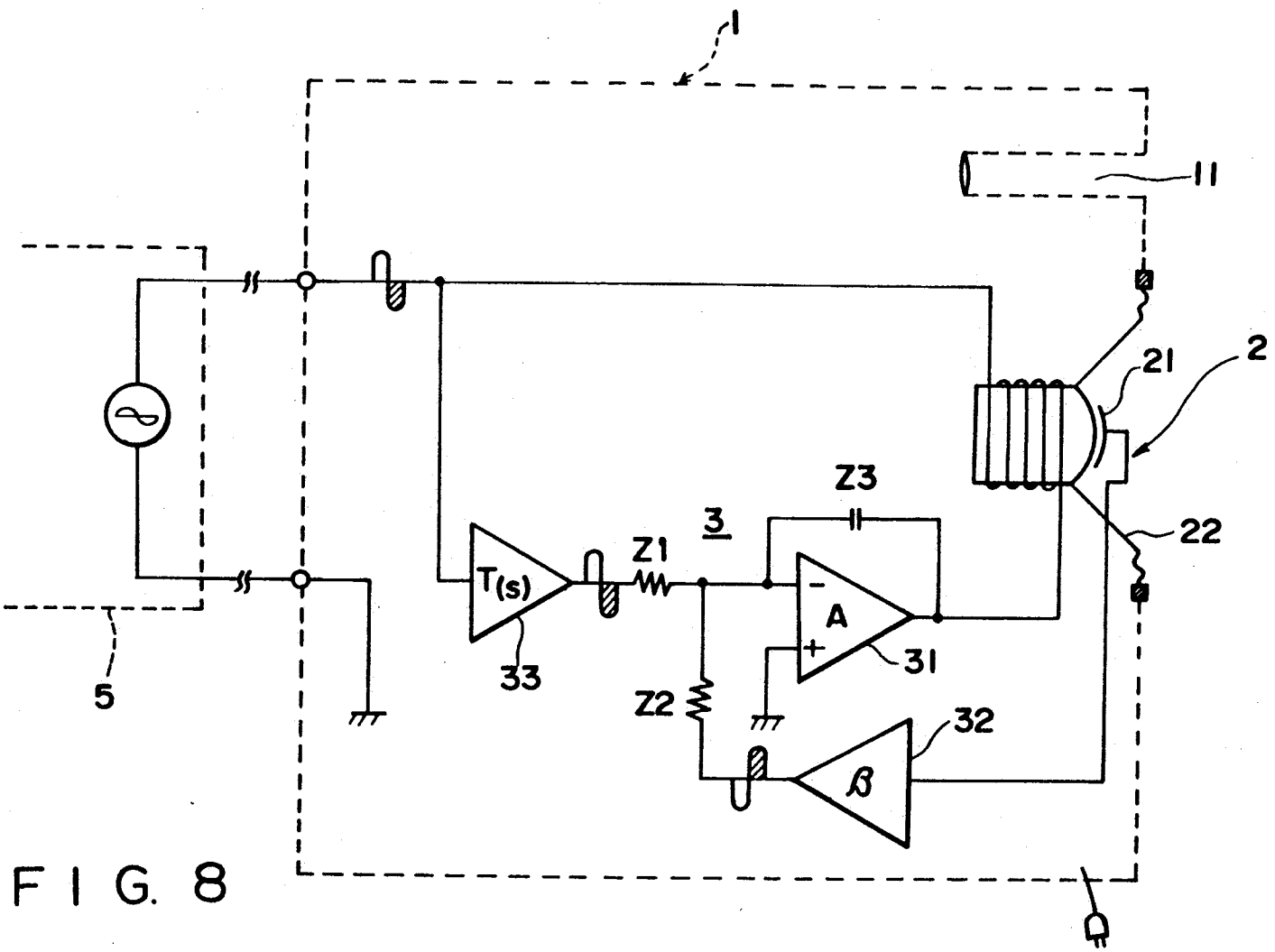
FIG. 8 is a circuit diagram of an acoustic apparatus according to the fifth embodiment of the present invention.

FIG. 8 shows the fifth embodiment of the present invention. This acoustic apparatus can perform the same MFB (motional feedback) driving as in the acoustic apparatus disclosed in European Patent Application Publication No. 0 332 053 by utilizing the general-purpose power amplifier 5. In this apparatus, a loudspeaker unit 2 having a vibration sensor 21, and an amplifier unit 3 serving as an MFB driving apparatus as the characteristic feature of the embodiment are arranged in a cabinet 1 having a resonance duct port 11. Furthermore, this apparatus also has a pair of external input terminals P1 and P2 for connecting this acoustic apparatus to the output terminals of the power amplifier 5 as the general-purpose power amplifier. In this embodiment, one external input terminal P1 is connected to one input terminal P3 of the loudspeaker unit 2, and the other input terminal P4 of the loudspeaker unit 2 is connected to an operation reference potential point of the amplifier unit 3. A detection output of a vibration state of the loudspeaker unit 2 by the vibration sensor 21 is negatively fed back to the input of a power amplifier circuit 31 of the amplifier unit 3, and a signal supplied to the external input terminal P1 is supplied to the input of the power amplifier circuit 31 via a transfer function control circuit 33 having a predetermined transfer function.

The vibration sensor 21 detects a vibration state of a diaphragm 22 of the loudspeaker unit 2 by any method, and comprises, e.g., a velocity sensor, a displacement sensor, acceleration sensor, or the like. Note that in place of the vibration sensor 21, a vibration state may be detected using a bridge circuit, as described in European Patent Application Publication No. 0 332 053. The amplifier unit 3 comprises the power amplifier circuit 31, a negative feedback circuit 32', and the transfer function control circuit 33. The negative feedback circuit 32' amplifies the detection output of the vibration sensor 21 or the vibration state detection bridge circuit with a predetermined transfer function $\beta$, and inputs the amplified output to the inverting input terminal of the power amplifier circuit 31.

In the acoustic apparatus shown in FIG. 8, the amplifier unit 3 cooperates with the general-purpose power amplifier 5, and the same MFB driving as in the acoustic apparatus disclosed in European Patent Application Publication No. 0 332 053 is performed as a whole.

What is claimed is:

1. An acoustic apparatus comprising:

a loudspeaker unit;

a first power amplifier for receiving an input signal and substantially supplying a first output signal according to the input signal to the loudspeaker unit by constant-voltage-driving, the first power amplifier having an output side; and a second power amplifier having an input side connected to the output side of the first power amplifier, for generating an electric energy other than energy generated by the constant-voltage-driving according to the first output signal as a second output signal and for substantially directly supplying the second output signal to the loudspeaker unit, the second output signal being supplied to the loudspeaker unit together with the first output signal.

2. An apparatus according to claim 1, wherein the electric energy generated by the second power amplifier corresponds to an increase in energy caused by a characteristic improving driving operation which is a negative-impedance driving operation.

3. An apparatus according to claim 1, wherein the electric energy generated by the second power amplifier corresponds to an increase in energy caused by a characteristic improving driving operation which is a motional feedback driving operation.

4. An apparatus according to claim 1, wherein said second power amplifier is disposed in a cabinet where said loudspeaker unit is disposed.

5. An apparatus according to claim 4, wherein said cabinet has a resonator structure.

6. An apparatus according to claim 5, wherein said cabinet has a resonance duct port.

7. An acoustic apparatus for receiving an output signal of an external power amplifier which normally constant-voltage-drives a loudspeaker and for driving a loudspeaker unit in cooperation with the external power amplifier, comprising:

a power amplifier circuit having an output terminal connected to one input terminal of said loudspeaker unit;

a first external input terminal for transmitting the output signal of the external power amplifier to another input terminal of said loudspeaker unit;

a second external input terminal connected to an operation reference potential point of said power amplifier circuit;

a positive feedback circuit connected to the loudspeaker unit in series, for detecting a current flowing through said loudspeaker unit and for positively feeding back a detection output corresponding to the detected current to an input side of said power amplifier circuit; and a transfer function circuit for transmitting the output signal supplied to said first external input terminal to said input side of said power amplifier circuit via a predetermined transfer function.

8. An acoustic apparatus according to claim 7, further comprising a cabinet for housing said loudspeaker unit and an amplifier unit comprising said power amplifier circuit, said positive feedback circuit, and said transfer function circuit.

9. An apparatus according to claim 8, wherein said cabinet has a resonator structure.

10. An apparatus according to claim 9, wherein said cabinet has a resonance duct port.

11. An acoustic apparatus for receiving an output signal of an external power amplifier which normally constant-voltage-drives a loudspeaker and for driving a loudspeaker unit comprising a vibration body and a means for detecting a vibration state of the vibration body, in cooperation with the external power amplifier which normally constant-voltage drives a loudspeaker, comprising:

a power amplifier circuit having an output terminal connected to one input terminal of said loudspeaker unit;

a first external input terminal for transmitting an output signal of the external power amplifier to another input terminal of said loudspeaker unit;

a second external input terminal connected to an operation reference potential point of said power amplifier circuit;

a negative feedback circuit connected to the loudspeaker unit in series, for negatively feeding back a detection output of the vibration state of the vibration body to an input side of said power amplifier circuit; and a transfer function control circuit for transmitting the output signal supplied to said first external input terminal to said input side of said power amplifier circuit via a predetermined transfer function.

12. An acoustic apparatus according to claim 11, further comprising a cabinet for housing said loudspeaker unit and an amplifier unit comprising said power amplifier circuit, said negative feedback circuit, and said transfer function circuit.

13. An apparatus according to claim 12, wherein said cabinet has a resonator structure.

14. An apparatus according to claim 13, wherein said cabinet has a resonance duct port.

15. A driving apparatus for driving a loudspeaker to improve electro-acoustic reproduction characteristics in cooperation with an external power amplifier having an output terminal and whose output impedance is substantially zero, comprising:

a connection circuit for transmitting an output signal at the output terminal of said external power amplifier to one input terminal of said loudspeaker;

a power amplifier circuit for receiving a signal at said one output terminal of said external power amplifier and using the other output terminal of said external power amplifier as an operation reference potential point, for amplifying said received signal with a predetermined transfer function, and for driving the other input terminal of said loudspeaker; and a feedback circuit for detecting a driving or operation state of said loudspeaker and feeding back a detection output to an input side of said power amplifier circuit.

16. An apparatus according to claim 15, wherein said feedback circuit detects a current flowing through said loudspeaker as the detection output.

17. An apparatus according to claim 15, wherein said feedback circuit positively feeds back the current detected from said loudspeaker, and negative-impedance-drives said loudspeaker in cooperation with said power amplifier circuit.

18. An apparatus according to claim 15, wherein said feedback circuit detects a vibration state of said loudspeaker, negatively feeds back a detection signal, and motional-feedback-drives said loudspeaker in cooperation with said power amplifier circuit.

* * * * *